US011519153B2

(12) United States Patent
Coudry

(10) Patent No.: US 11,519,153 B2
(45) Date of Patent: Dec. 6, 2022

(54) BORING MACHINE FOR PRODUCING A NON-RECTILINEAR TRENCH

(71) Applicant: SOLETANCHE FREYSSINET, Rueil Malmaison (FR)

(72) Inventor: Michel Coudry, Rueil Malmaison (FR)

( * ) Notice: Subject to any disclaimer, the term of this patent is extended or adjusted under 35 U.S.C. 154(b) by 47 days.

(21) Appl. No.: 16/650,057

(22) PCT Filed: Sep. 24, 2018

(86) PCT No.: PCT/FR2018/052329
§ 371 (c)(1),
(2) Date: Mar. 24, 2020

(87) PCT Pub. No.: WO2019/058078
PCT Pub. Date: Mar. 28, 2019

(65) Prior Publication Data

US 2020/0291603 A1 Sep. 17, 2020

(30) Foreign Application Priority Data

Sep. 25, 2017 (FR) ..... 17 58837

(51) Int. Cl.

| | |
|---|---|
| ***E02F 5/08*** | (2006.01) |
| ***E02D 17/06*** | (2006.01) |
| ***E02F 3/18*** | (2006.01) |
| ***E02F 3/24*** | (2006.01) |

(52) U.S. Cl.
CPC ..... *E02F 5/08* (2013.01); *E02D 17/06* (2013.01); *E02F 3/188* (2013.01); *E02F 3/241* (2013.01)

(58) Field of Classification Search
CPC ... E02F 3/241; E02F 3/243; E02F 5/08; E02F 3/188; E02D 17/06
USPC ..... 37/94
See application file for complete search history.

(56) References Cited

U.S. PATENT DOCUMENTS

| | | | | | |
|---|---|---|---|---|---|
| 114,395 | A | * | 5/1871 | Boas | E02F 3/20 37/94 |
| 1,289,884 | A | * | 12/1918 | Opalka | A01B 33/021 172/70 |
| 1,843,095 | A | * | 1/1932 | Urschel | A01B 39/08 172/115 |
| 2,718,838 | A | * | 9/1955 | Schumacher | A01G 3/062 172/16 |
| 3,483,929 | A | * | 12/1969 | MacIntyre et al. | G03B 15/05 172/63 |

(Continued)

FOREIGN PATENT DOCUMENTS

| | | | | |
|---|---|---|---|---|
| CN | 106088046 | A * | 11/2016 | E02F 3/20 |
| CN | 106088048 | A * | 11/2016 | E02F 3/20 |

(Continued)

*Primary Examiner* — Tara Mayo-Pinnock
(74) *Attorney, Agent, or Firm* — Robert Facey

(57) ABSTRACT

A boring machine for producing a trench in the ground including a chassis that extends in a longitudinal direction, the chassis having a lower end, the machine including a boring device mounted at the lower end of the chassis, the boring device including a first boring member which is rotary about a first axis of rotation, and a second boring member which is rotary about a second axis of rotation, the second axis of rotation and the first axis of rotation extending in a plane perpendicular to the longitudinal direction, wherein the first axis of rotation is inclined with respect to the second axis of rotation.

21 Claims, 4 Drawing Sheets

(56) References Cited

U.S. PATENT DOCUMENTS

| | | | | |
|---|---|---|---|---|
| 3,681,863 | A * | 8/1972 | Solntsev et al. | E02F 3/06 37/97 |
| 4,416,335 | A * | 11/1983 | Lofgren et al. | A01B 33/00 172/120 |
| 4,535,555 | A * | 8/1985 | Petraud | E02F 3/20 37/94 |
| 4,883,134 | A | 11/1989 | Soletanche | |
| 5,082,063 | A * | 1/1992 | Sidders | A01C 5/064 172/686 |
| 6,085,446 | A | 7/2000 | Posch | |
| 7,476,057 | B2 * | 1/2009 | Arzberger et al. | E02D 17/13 405/267 |
| 7,765,723 | B2 | 8/2010 | Sol | |
| 8,640,364 | B2 * | 2/2014 | Arzberger et al. | E02F 3/205 37/189 |
| 2009/0165338 | A1 * | 7/2009 | Chagnot et al. | E02F 3/205 37/189 |
| 2011/0253450 | A1 * | 10/2011 | Arzberger et al. | E02F 3/205 175/57 |

FOREIGN PATENT DOCUMENTS

| | | | | |
|---|---|---|---|---|
| CN | 106088057 | A * | 11/2016 | |
| DE | 1634487 | A1 | 10/1970 | |
| EP | 0253726 | A1 | 1/1988 | |
| EP | 0496926 | A1 | 8/1992 | |
| EP | 0922811 | A2 * | 6/1999 | E02F 3/962 |
| EP | 2553175 | A1 | 2/2013 | |
| FR | 2211027 | A5 | 12/1972 | |
| JP | H0441529 | U | 4/1992 | |
| JP | H05 280038 | A | 10/1993 | |
| JP | H10 140601 | A | 5/1998 | |
| JP | H10227028 | A | 8/1998 | |
| JP | S63304822 | A | 12/1998 | |
| JP | 2003 171952 | A | 6/2003 | |

* cited by examiner

BORING MACHINE FOR PRODUCING A NON-RECTILINEAR TRENCH

BACKGROUND

The present disclosure relates to the field of the fabrication of trenches in the ground, and more particularly non-rectilinear trenches, notably curved, oval or circular. It has an application to diaphragm walls formed in the ground, notably curved, oval, ring-shaped or circular walls.

The tools intended to fabricate rectilinear trenches in the ground are known since the 1970s. In particular the document FR 2 211 027 is known to describe a boring machine for producing this type of trench.

The disclosure more particularly relates to this type of machine which comprises a chassis that extends in a longitudinal direction, said chassis having a lower end, the machine including a boring device mounted at the lower end of the chassis, the boring device including:

- a first boring member which is rotary about a first axis of rotation;
- a second boring member which is rotary about a second axis of rotation;

To produce trenches of generally circular shape, several techniques are used. A first technique consists in using the machine of document FR 2 211 027 and in producing a series of trenches of cross-sections—said sections being considered in a horizontal plane—which are rectangular and inclined with respect to one another, the inclination being considered in a horizontal plane. One drawback is that this method does not make it possible to obtain a precise circular shape.

This method generally consists in producing two primary walls distant from one another and in then producing a secondary wall linking the two previously executed primary walls. The production of the secondary wall requires the reboring of a part of the primary walls over a certain thickness.

In the case of a curved wall, a first difficulty lies in the fact that the thickness of concrete to be rebored is much greater on the inside of the curve that on the outside, which poses problems of maintaining of the borepath.

A second difficulty lies in the fact that the reboring to a considerable thickness incurs an overconsumption of power and consumable cutting tools.

To remedy this difficulty, document EP 2 553 175 proposes to use a reinforcement cage equipped with sacrificial parts arranged on either side of the body of the reinforcement cage. One drawback of this method notably lies in the cost of fabrication of specific reinforcement cages.

Another drawback is that the structure thus obtained has a polygonal shape, the production of which requires a quantity of concrete greatly in excess of that which would be necessary to obtain a truly circular wall.

A technique for producing a circular wall composed of a juxtaposition of secant or contiguous piles is also known, but this is a technique which has the drawback of being limited in wall thickness.

SUMMARY

An aim of the present disclosure is to propose a boring machine for producing non-rectilinear walls, for example ring-shaped or partly ring-shaped, or else walls of concertina or zig-zag shape, avoiding the aforementioned drawbacks.

The disclosure achieves its aim by the fact that the first axis of rotation is inclined with respect to the second axis of rotation.

It will be understood that this inclination is considered in the plane perpendicular to the longitudinal direction, wherein extend the first and second axes of rotation.

As the first axis of rotation is inclined with respect to the second axis of rotation, the cross-section of the trench, considered in a horizontal plane, has a shape similar to that of a ring-shaped portion of wall, this shape being substantially trapezoidal.

It will be understood that the juxtaposition of trenches, the cross-section of which, considered in a horizontal plane, is of substantially trapezoidal shape makes it possible to easily fabricate a wall having a polygonal shape, close to a ring shape.

To do this, it will for example be possible to produce two primary panels distant from one another, then produce a secondary panel between the two primary panels by reboring the concrete of the primary panels. Owing to the substantially trapezoidal shape, it is possible to rebore the concrete of the primary panels in such a way that the reboring thickness is constant over the entire width of the rebored primary panel.

Without departing from the scope of the present disclosure, the boring machine could include a third boring member similar and coaxial to the first boring member, and a fourth boring member similar and coaxial to the second boring member.

Advantageously, at least the first boring member has a truncated cone shape.

It will be understood that the truncated cone shape of the first boring member makes it possible to obtain a cross-section of the trench, considered in a horizontal plane, which has a substantially trapezoidal shape nearing a section in the shape of a ring-shaped portion.

Preferably, the first boring member includes at least one cutting drum of truncated cone shape which is rotary about the first axis of rotation.

Still preferably, the cone angle of the first cutting drum is substantially equal to the angle of inclination between the first and second axes of rotation.

Preferably, the cone angle is between 2° and 30°.

According to an advantageous aspect, the first cutting drum includes a cylindrical body having a peripheral face extending between a first side and a second side, opposite the first side, and the peripheral face is equipped with cutting teeth, the radial heights of which vary in an increasing manner from the first side toward the second side.

It will be understood that the cutting teeth are contained within the volume of the first cutting drum. In other words, the heights of the teeth are dimensioned so that their tips define the general truncated cone shape of the first cutting drum.

The cylindrical body preferably has a circular section.

It will therefore be understood that it is the cutting teeth that define the truncated cone shape of the first cutting drum.

Advantageously, the first boring member further includes a second cutting drum of truncated cone shape, rotary about the first axis of rotation.

It will therefore be understood that the first and second cutting drums are coaxial.

Preferably, the second cutting drum includes a cylindrical body having a peripheral face extending between a first side and a second side, opposite the first side, and the peripheral face is equipped with the cutting teeth, the radial heights of which vary in an increasing manner from the first side toward the second side.

Here again it will be understood that it is the cutting teeth that define the truncated cone shape of the second cutting drum.

Moreover, the first side of the second cutting drum is adjacent to the second side of the first cutting drum.

Additionally, the truncated cone shapes of the first and second cutting drums are arranged in the continuation of each other in such a way as to define the truncated cone shape of the first section member.

Advantageously, the boring device includes a first motor arranged in the first and second cutting drums in order to rotationally drive the first boring member about the first axis of rotation.

Preferably, the first motor is a hydraulic motor housed in the cylindrical bodies of the first and second cutting drums. This type of incorporation of the motor into the cutting drums is known to the prior art and will not be described in detail here.

Advantageously the second boring member also has a truncated cone shape.

Preferably, the second boring member is similar to the first boring member.

Also, the second boring member preferably includes at least a third cutting drum of truncated cone shape identical to the first cutting drum, the third cutting drum being rotary about the second axis of rotation.

Still preferably, the second boring member further includes a fourth cutting drum of truncated cone shape identical to the second cutting drum, the fourth cutting drum being rotary about the second axis of rotation.

Preferably, the boring device includes a second motor arranged in the third and fourth cutting drums in order to rotationally drive the second boring member about the second axis of rotation.

This second motor is preferably a hydraulic motor housed in the cylindrical bodies of the third and fourth cutting drums.

According to an advantageous aspect of the disclosure, the greatest distance between the cutting teeth of the first boring member and the cutting teeth of the second boring member is less than or equal to 2 cm. One benefit is to avoid the formation of a merlon between the first and second boring members at the trench bottom.

Preferably, the angle of inclination between the first and second axes of rotation is between 2° and 30°. The value of the angle will be chosen as a function of the radius of curvature of the ring-shaped portion of wall or as a function of the diameter of the circular wall that one wishes to obtain.

Preferably, but not necessarily, the first and second axes of rotation are coplanar. Still preferably, but not exclusively, the first and second axes of rotation extend in a plane which is perpendicular to the longitudinal direction of the chassis. However, without departing from the scope of the present disclosure, said plane could be inclined with respect to the longitudinal direction, for example in such a way that the generator of the cone formed by the first boring member is substantially perpendicular to the longitudinal direction of the chassis, such that said generator extends substantially horizontally.

The disclosure also concerns a method for construction of a diaphragm wall, wherein at least a first primary panel is produced in the ground, at least a second primary panel is produced in the ground, distant from the first primary panel, the second primary panel being inclined with respect to the first primary panel, then a secondary panel is produced between the first and second primary panels, by milling the lateral edges of the first and second primary panels using the boring machine according to the disclosure.

It will therefore be understood that, considered in a horizontal plane, the first and second primary panels are inclined with respect to one another.

Advantageously, the first primary panel is produced using the boring machine according to the disclosure. Preferably, the second primary panel is also produced using the boring machine according to the disclosure.

In a preferred method of implementation the diaphragm wall is curved or ring-shaped.

BRIEF DESCRIPTION OF THE DRAWINGS

The disclosure will be better understood on reading the following description of an embodiment of the disclosure given by way of non-limiting example, with reference to the appended drawings, wherein.

DETAILED DESCRIPTION

Figure 1A:
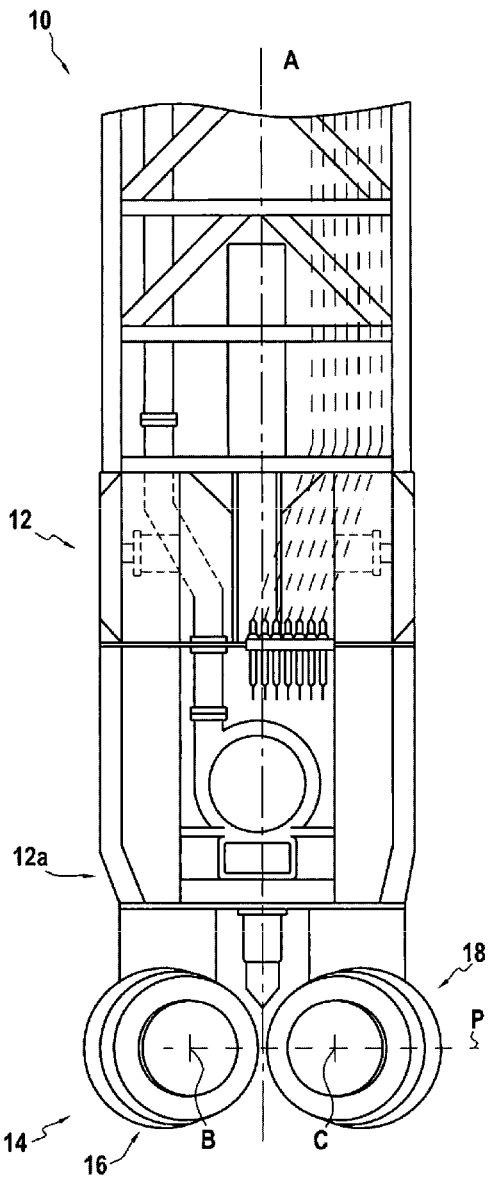
FIG. 1A is a front view of a boring machine according to the present disclosure.
Figure 1B:
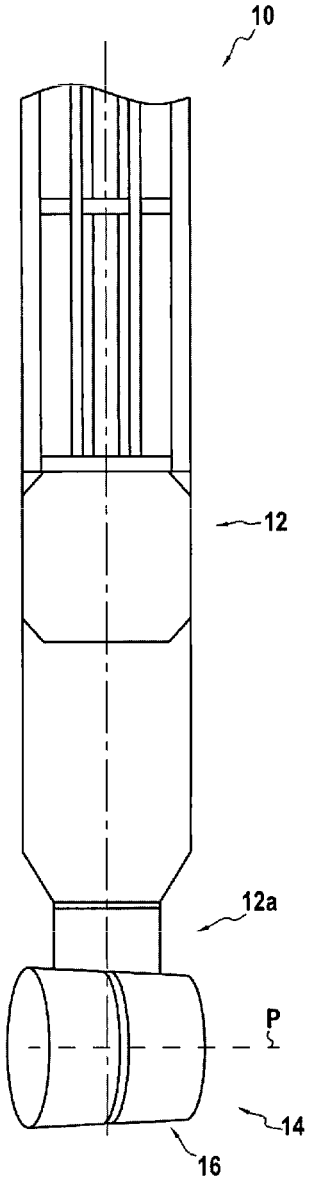
FIG. 1B is a side view of the boring machine in FIG. 1.

In FIGS. 1A and 1B a boring machine 10 in accordance with the present disclosure is represented, in front and side view.

This boring machine 10 is a cutter that is intended to produce a vertical trench R in the ground S, the trench having a horizontal section of a particular shape, which will be described below.

The boring machine 10 includes a chassis 12 which extends in a longitudinal direction A, preferably vertical. The chassis 12 extends in the longitudinal direction A between a lower end 12*a* and an upper end (not illustrated).

In this example, the boring machine 10 is suspended from a supporting cable (not illustrated here) which is connected in a known manner to the upper end of the chassis 12.

The boring machine 10 moreover includes a boring device 14 which is mounted at the lower end 12*a* of the chassis 12. The trench 11 is executed by making the boring device and the chassis vertically penetrate the ground S.

The boring device 14 includes a first boring member 16 which is rotary about a first axis of rotation B and a second boring member 18 which is rotary about a second axis of rotation C.

As can be observed in FIGS. 1A and 1B, the second axis of rotation C and the first axis of rotation B extend in a plane P which is perpendicular to the longitudinal direction A. In this example, the plane P is substantially horizontal. Without departing from the scope of the present disclosure, the first and second axes of rotation could be non-coplanar. In another embodiment, the plane P could be inclined with respect to the longitudinal direction.

As can be observed in FIG. 1A, the first and second boring members are substantially symmetrical with respect to one another, with respect to a vertical plane passing through the median longitudinal axis of the chassis.

In accordance with the present disclosure, the first axis of rotation B is inclined with respect to the second axis of rotation C. This inclination is considered in the horizontal plane P.

Figure 2:
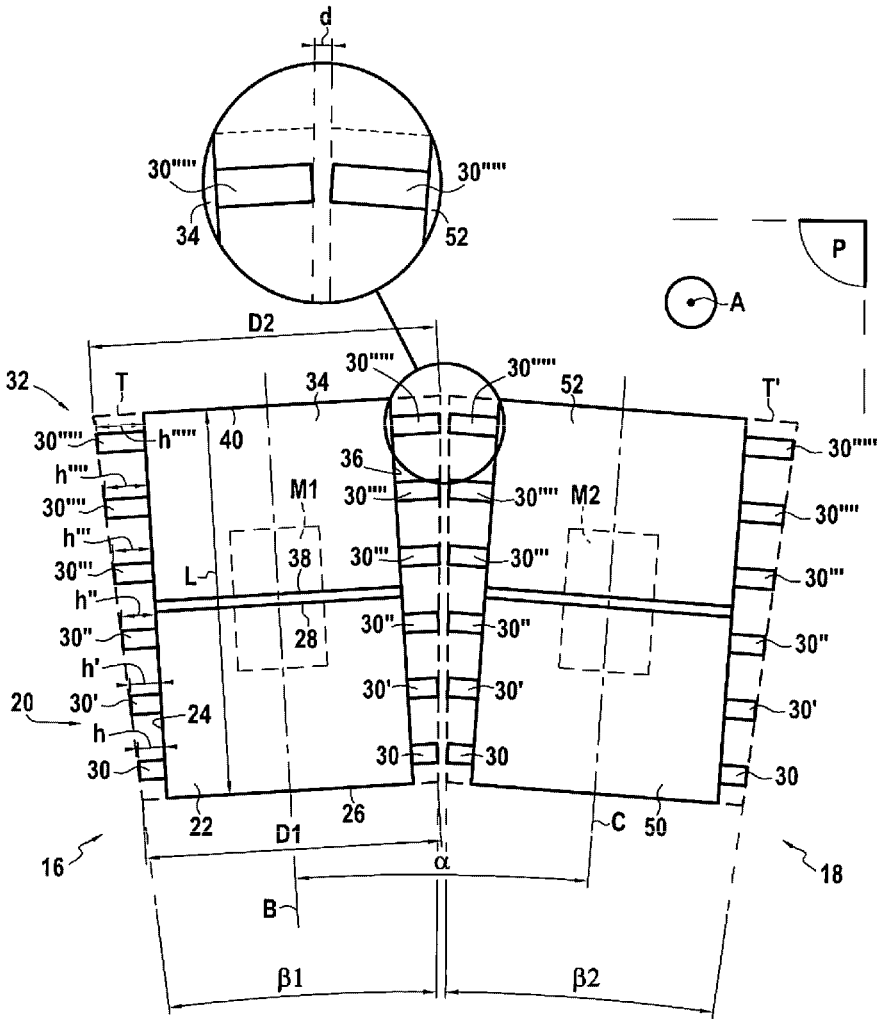
FIG. 2 is a detail view of the boring device, in top view.

In FIG. 2 are illustrated the first and second boring members 16, 18 in projection in the aforementioned plane P. The angle of inclination between the first and second axes of rotation is referenced α.

It can be observed that the first boring member 16 has a truncated cone shape T, the latter being schematized by dashed lines in FIG. 2. Similarly, the second boring member 18 has a truncated cone shape T', the latter also being schematized by the dashed lines in FIG. 2.

It can also be seen that the first and second boring members are identical and are inclined with respect to one another by an angle corresponding to the angle of inclination α between the first and second axes of rotation B,C.

The cone angle β1 of the first boring member 16 is substantially equal to the angle of inclination α between the first and second axes of rotation B, C. Similarly, the cone angle β2 of the second boring member 18 is substantially equal to the angle of inclination a between the first and second axes of rotation B, C.

Moreover, the first boring member 16 includes a first cutting drum 20 of truncated cone shape which is rotary about the first axis of rotation B.

The cone angle β1 of the first cutting drum 20 is substantially equal to the angle of inclination α between the first and second axes of rotation B, C.

The first cutting drum 20 includes a cylindrical body 22 having a peripheral face 24 which extends axially, along the first axis of rotation B, between a first side 26 and a second side 28 opposite the first side 26. It will be understood that the first and second sides 26, 28 are parallel and extend in planes perpendicular to the first axis of rotation B. The peripheral face 24 itself winds around the first axis of rotation B.

Moreover, the peripheral face 24 is equipped with cutting teeth 30,30',30" which extend radially. The cutting teeth 30, 30', 30" have radial heights which vary in an increasing manner from the first side 26 toward the second side 28.

In FIG. 2, it can be seen that the first cutting drum 20 includes a series of cutting teeth 30 which each have a radial height h, this first series of teeth 30 extending along the circumference of the cylindrical body 22.

Moreover, the first series of cutting teeth 30 is arranged close to the first side 26. The first cutting drum 20 moreover includes a second series of cutting teeth 30' having a radial height h', the cutting teeth 30' of the second series also extending along the circumference of the cylindrical body 22. Finally, in this non-limiting example, the first cutting drum 20 further includes a third series of cutting teeth 30", extending along the circumference of the cylindrical body 22, while being arranged close to the second side 28.

Hence, it will be understood that the second series of cutting teeth 30' is arranged between the first and third series of cutting teeth 30, 30".

It also will be understood that the radial height h" is greater than the height h' which is itself greater than the radial height h.

In this example, these three radial heights h, h' and h" are chosen such that the external geometrical envelope of the first cutting drum 20 has a truncated cone shape, the cone angle β1 of which is substantially equal to the angle of inclination α.

It will therefore be understood that it is the variation of the radial heights of the cutting teeth, this variant being increasing, considered axially along the first axis of rotation, from the first side 26 toward the second side 28, which gives the first cutting drum 20 its truncated cone shape.

Without departing from the scope of the present disclosure, provision may obviously be made for a number of series of teeth less than or greater than three. Moreover, the first boring member 16 further includes a second cutting drum 32, which is also rotary about the first axis of rotation B.

The second cutting drum 32 is similar to the first cutting drum 22 and also has a truncated cone shape, the cone angle β2 of which is substantially equal to the angle β1, and therefore substantially to the angle of inclination α.

The second cutting drum 32 includes a cylindrical body 34 which has a peripheral face 36 extending between a first side 38 and a second side 40. It will be understood that the first side 38 of the cylindrical body 34 of the second cutting drum 32 is adjacent to the second side 28 of the cylindrical body 22 of the first cutting drum 20.

The peripheral face 36 of the cylindrical body of the second cutting drum is also equipped with a fourth, fifth and sixth series of cutting teeth 30''', 30'''', 30'''''.

It will be understood that the radial heights h''', h'''', h''''' of the cutting teeth of the fourth, fifth and sixth series of cutting teeth 30''', 30'''', 30''''', vary in an increasing manner, from the first side 38 toward the second side 40 of the cylindrical body 34 of the second cutting drum 32. In other words, the radial height h''''' of the cutting teeth of the sixth series is greater than the radial height h'''' of the cutting teeth of the fifth series, and is also greater than the radial height h''' of the cutting teeth of the fourth series.

Also, the radial heights h, h', h", h''', h'''', h''''' are chosen in such a way that the first boring member 16 has the truncated cone shape T of cone angle β1.

In this non-limiting example, considered in a horizontal plane, the length D1 of the small side of the first boring member 16, corresponding to the first side of the first cutting drum is in the order of 1 300 mm, whereas the length D2 of the large side of the first boring member 16, corresponding to the second side of the second cutting drum is in the order of 1 500 mm. The width L of the first boring member, corresponding to the thickness of the ring-shaped wall portion, is in the order of 1 500 mm. Such values make it possible to obtain a ring-shaped wall having an average radius of curvature in the order of 14 m.

To make the first boring member 16 rotate about the axis of rotation B, the boring device includes a first motor M1, preferably a hydraulic motor, which is arranged in the first and second cutting drums 20,32 in order to rotationally drive the first boring member about the first axis of rotation A.

The first motor M1 may be supplied by hydraulic lines which extend in the chassis 12.

As can be further seen in FIG. 2, the second boring member 18 also has a truncated cone shape T', similar to the truncated cone shape T of the first boring member 16.

Like the first boring member, the second boring member 18 includes a third cutting drum 50, of truncated cone shape, which is identical to the first cutting drum, 22, the third cutting drum 50 being rotary about the second axis of rotation C. The third drum 50 thus includes cutting teeth identical to those of the first cutting drum 22.

The second boring member 18 further includes a fourth cutting drum 52, of truncated cone shape, which is identical to the second cutting drum. Moreover, the fourth cutting drum is rotary about the second axis of rotation C.

Moreover, the boring device further includes a second motor M2 arranged in the third and fourth cutting drums 50,52 in order to rotationally drive the second boring member 18 about the second axis of rotation C. Here again the second motor M2 may be a hydraulic motor, moreover known.

It is specified here that the rotational driving of the cutting drums, using hydraulic motors, is already known in the case where the axes of rotation of the boring members are mutually parallel.

According to another advantageous aspect of the disclosure, the greatest distance d between the cutting teeth of the first boring member and the cutting teeth of the second boring member, illustrated in FIG. 2, is less than or equal to 2 cm.

Moreover, the angle of inclination a between the first and second axes of rotation B, C is in this example, in the order of 6° to 8°.

Without departing from the scope of the disclosure, provision may be made for a range of values between 2° and 30° according to the type of structure that one wishes to produce.

Figure 3:
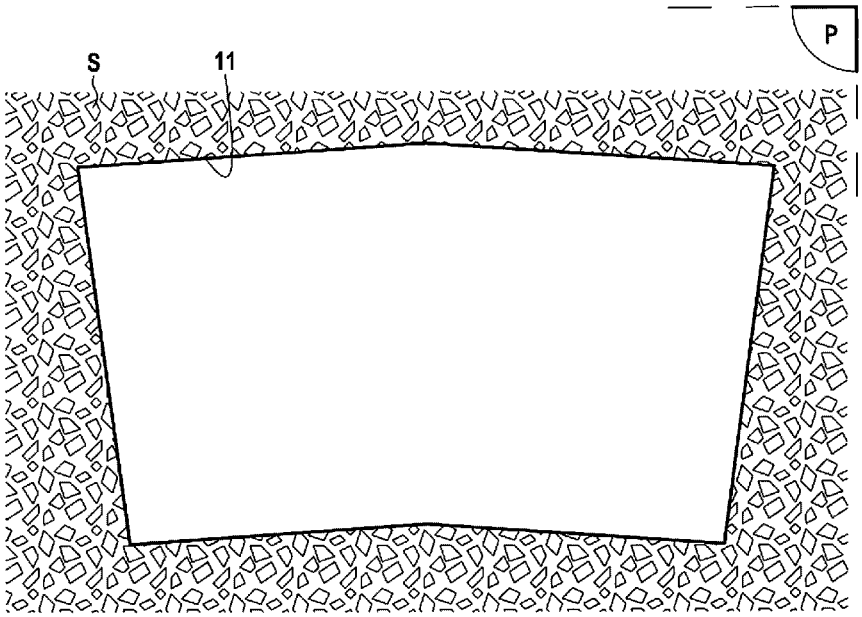
FIG. 3 illustrates the section of the trench, considered in a horizontal plane, produced using the boring device in FIG. 2.

In FIG. 3, is illustrated the cross-section of the trench produced using the boring device of the boring machine according to the disclosure, the section being illustrated in the horizontal plane P.

Figure 4A:
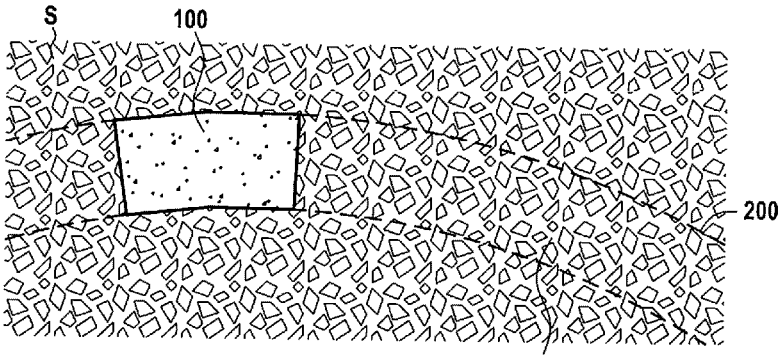
FIGS. 4A to 4C illustrate the fabrication of a ring-shaped diaphragm wall portion by the implementation of the method according to the disclosure.
Figure 4B:
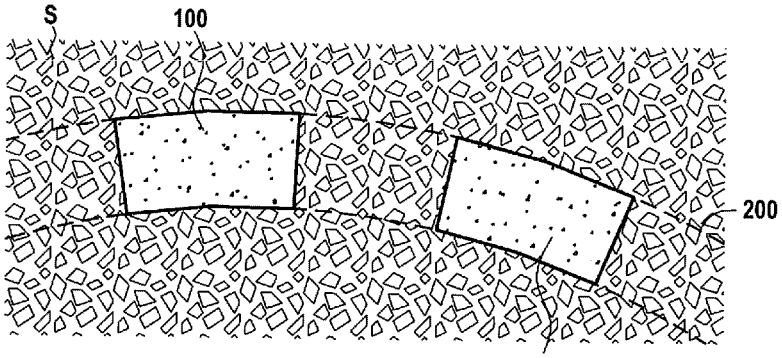
Figure 4C:
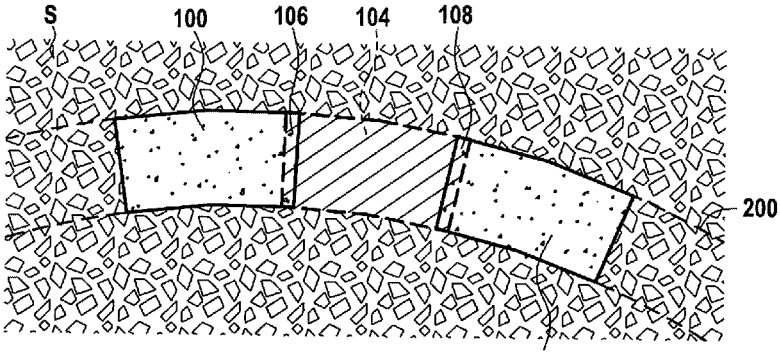

In FIG. 4, is illustrated a ring-shaped wall portion obtained using the boring machine according to the disclosure.

The wall portion illustrated in FIG. 4 is produced using the method for construction of a diaphragm wall according to the disclosure. According to this method, at least a first primary panel 100 is produced in the ground S, then at least a second primary panel 102 is produced in the ground distant from the first primary panel 100, the second primary panel 102 being inclined with respect to the first primary panel 100.

Then, a secondary panel 104 is produced between the first and second primary panels 100, 102 by milling the lateral edges 106, 108 of the first and second primary panels using the boring machine 10 according to the disclosure.

Preferably, in this example, the first primary panel, along with the second primary panel, are produced using the machine according to the disclosure.

In this example, the trenches of the primary panels are bored under drilling mud, before being filled with concrete during the raising of the boring device.

Figure 5:
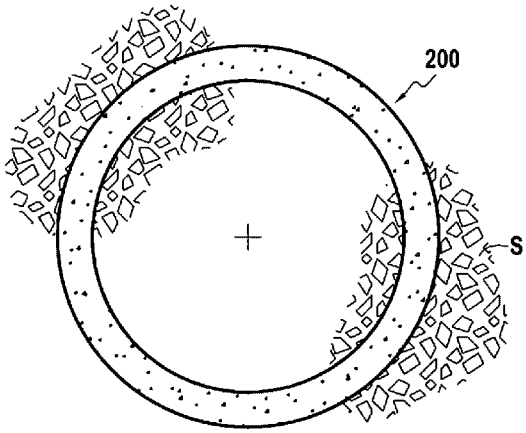
FIG. 5 illustrates a ring-shaped diaphragm wall obtained by the implementation of the method according to the disclosure.

It will be understood that the construction method according to the disclosure notably makes it possible to produce the ring-shaped diaphragm wall 200 illustrated in FIG. 5.

The invention claimed is:

1. A boring machine for producing a trench in the ground, comprising a chassis that extends in a longitudinal direction, said chassis having a lower end, the machine including a boring device mounted at the lower end of the chassis, the boring device including:

a first boring member which is rotary about a first axis of rotation, the first boring member having a truncated cone shape and including at least a first cutting drum of truncated cone shape which is rotary about the first axis of rotation;

a second boring member which is rotary about a second axis of rotation;

wherein the first axis of rotation is inclined with respect to the second axis of rotation, and wherein the first cutting drum includes a cylindrical body having a peripheral face extending between a first side and a second side, opposite the first side, and wherein the peripheral face is equipped with cutting teeth, the radial heights of which vary in an increasing manner from the first side toward the second side.

2. The boring machine as claimed in claim 1, wherein the cone angle of the first cutting drum is substantially equal to the angle of inclination between the first and second axes of rotation.

3. The boring machine as claimed in claim 1, wherein the first boring member further includes a second cutting drum of truncated cone shape, rotary about the first axis of rotation.

4. The boring machine as claimed in claim 3, wherein the boring device includes a first motor arranged in the first and second cutting drums in order to rotationally drive the first boring member about the first axis of rotation.

5. The boring machine as claimed in claim 1, wherein the second boring member has a truncated cone shape.

6. The boring machine as claimed in claim 1, wherein the second boring member has a truncated cone shape and wherein the second boring member includes at least a cutting drum of truncated cone shape identical to the first cutting drum, the cutting drum of the second boring member being rotary about the second axis of rotation.

7. The boring machine as claimed in claim 1, wherein the first boring member further includes a second cutting drum of truncated cone shape, rotary about the first axis of rotation, wherein the second boring member includes a third cutting drum of truncated cone shape identical to the first cutting drum, the third cutting drum being rotary about the second axis of rotation, and wherein, the second boring member further includes a fourth cutting drum of truncated cone shape identical to the second cutting drum, the fourth cutting drum being rotary about the second axis of rotation.

8. The boring machine as claimed in claim 7, wherein the boring device includes a second motor arranged in the third and fourth cutting drums in order to rotationally drive the second boring member about the second axis of rotation.

9. The boring machine as claimed in claim 1, wherein an angle of inclination between the first and second axes of rotation is between 2° and 30°.

10. A method for construction of a diaphragm wall comprising:

producing at least a first primary panel in the ground, producing at least a second primary panel in the ground, distant from the first primary panel, the second primary panel being inclined with respect to the first primary panel, then milling lateral edges of the first and second primary panels using a boring machine for producing a trench in the ground, and producing a secondary panel in the trench between the first and second primary panels, wherein said boring machine comprises a chassis that extends in a longitudinal direction, said chassis having a lower end, the machine including a boring device mounted at the lower end of the chassis, the boring device including:

a first boring member which is rotary about a first axis of rotation;

a second boring member which is rotary about a second axis of rotation, wherein the first axis of rotation is inclined with respect to the second axis of rotation.

11. The construction method as claimed in claim 10, wherein the first primary panel is produced using said boring machine.

12. The construction method as claimed in claim 10, wherein the diaphragm wall is curved or ring-shaped.

13. The construction method as claimed in claim 10, wherein the first and second boring members have truncated cone shape and comprise cutting teeth, and wherein the greatest distance between the cutting teeth of the first boring member and the cutting teeth of the second boring member is less than or equal to 2 cm.

14. The construction method as claimed in claim 10, wherein the shape of a horizontal section of the primary or secondary panel is substantially trapezoidal.

15. A boring machine for producing a trench in the ground, comprising a chassis that extends in a longitudinal direction, said chassis having a lower end, the machine including a boring device mounted at the lower end of the chassis, the boring device including:

a first boring member which is rotary about a first axis of rotation;

a second boring member which is rotary about a second axis of rotation;

wherein the first axis of rotation is inclined with respect to the second axis of rotation, and wherein the angle of inclination between the first and second axes of rotation being between 2° and 30°.

16. The boring machine as claimed in claim 15, wherein the first and second axes of rotation extend in a plane which is perpendicular to the longitudinal direction.

17. The boring machine as claimed in claim 15, wherein at least the first boring member has a truncated cone shape.

18. The boring machine as claimed in claim 17, wherein the first boring member includes at least a first cutting drum of truncated cone shape which is rotary about the first axis of rotation.

19. The boring machine as claimed in claim 18, wherein the first cutting drum includes a cylindrical body having a peripheral face extending between a first side and a second side, opposite the first side, and wherein the peripheral face is equipped with cutting teeth, the radial heights of which vary in an increasing manner from the first side toward the second side.

20. The boring machine as claimed in claim 15, wherein the greatest distance between cutting teeth of the first boring member and cutting teeth of the second boring member is less than or equal to 2 cm.

21. A boring machine for producing a trench in the ground, comprising a chassis that extends in a longitudinal direction, said chassis having a lower end, the machine including a boring device mounted at the lower end of the chassis, the boring device including:

a first boring member which is rotary about a first axis of rotation, the first boring member having a truncated cone shape and having cutting teeth;

a second boring member which is rotary about a second axis of rotation, the second boring member having a truncated cone shape and having cutting teeth;

wherein the first axis of rotation is inclined with respect to the second axis of rotation, and wherein the greatest distance between the cutting teeth of the first boring member and the cutting teeth of the second boring member is less than or equal to 2 cm.

* * * * *